US006220473B1

(12) United States Patent
Lehman et al.

(10) Patent No.: US 6,220,473 B1
(45) Date of Patent: Apr. 24, 2001

(54) COLLAPSIBLE VACUUM PANEL CONTAINER

(75) Inventors: Joseph Lehman, New Albany; Linda Siders, Reynoldsburg; Dwight Musgrave, Granville, all of OH (US); Mark W. Krivoruchka, Apple Valley; Stephen D. Prodoehl, Bloomington, both of MN (US)

(73) Assignee: Thermo Solutions, Inc., Minneapolis, MN (US)

( * ) Notice: Subject to any disclaimer, the term of this patent is extended or adjusted under 35 U.S.C. 154(b) by 0 days.

(21) Appl. No.: 09/616,590

(22) Filed: Jul. 14, 2000

Related U.S. Application Data

(60) Provisional application No. 60/143,696, filed on Jul. 14, 1999.

(51) Int. Cl.[7] ..... B65D 85/00

(52) U.S. Cl. ..... 220/592.27; 220/592.2; 220/592.24; 220/592.03; 150/901

(58) Field of Search ..... 220/592.27, 592.2, 220/592.24, 592.26, 592.03; 150/901; 62/457.2, 457.1

(56) References Cited

U.S. PATENT DOCUMENTS

| | | | | |
|---|---|---|---|---|
| 1,701,323 | | 2/1929 | Fredenhagen . | |
| 1,797,265 | | 3/1931 | Klopsteg . | |
| 1,895,278 | * | 1/1933 | Crawford | 220/592.24 X |
| 2,019,194 | | 10/1935 | Munters . | |
| 2,123,031 | * | 7/1938 | Weiner | 220/592.2 X |
| 2,304,757 | | 12/1942 | Arthur . | |
| 2,324,495 | * | 7/1943 | Deming | 220/592.2 |
| 2,484,310 | | 10/1949 | Philip . | |
| 2,768,046 | | 10/1956 | Evans . | |
| 2,817,123 | | 12/1957 | Jacobs . | |
| 2,969,164 | | 1/1961 | Morrison . | |
| 4,050,264 | * | 9/1977 | Tanaka | 62/457 |
| 4,892,226 | * | 1/1990 | Abtahi | 62/457.1 X |
| 5,032,439 | | 7/1991 | Glicksman et al. | 428/428 |
| 5,216,900 | * | 6/1993 | Jones | 62/457.2 |
| 5,316,171 | | 5/1994 | Danner, Jr. et al. | 220/220 |
| 5,512,345 | | 4/1996 | Tsutsumi et al. | 428/428 |
| 5,562,228 | * | 10/1996 | Ericson | 220/592.2 X |
| 5,918,478 | | 7/1999 | Bostic et al. | 62/62 |
| 5,950,450 | | 9/1999 | Meyer et al. | 62/62 |
| 6,036,047 | * | 3/2000 | Dobbie | 150/901 X |

OTHER PUBLICATIONS

Instill Vacuum Insulation Core Brochure Trademark of the Dow Chemical Company, Nov. 1999.

Optimizing Vacuum Insulation Panel Performance Using Instill Vacuum Insulation Core Brochure Trademark of the Dow Chemical Company, Sep. 1998.

* cited by examiner

*Primary Examiner*—Steven Pollard
(74) *Attorney, Agent, or Firm*—Kinney & Lange P.A.

(57) ABSTRACT

A soft-sided, collapsible insulative container having a flexible casing, a base, peripheral sidewalls extending from the base, and a lid. The sidewalls fold upward from the base at a fold hinge and releasably attach at their vertical edges to form an enclosure. The lid fits the top of the enclosure. Each of the sidewalls, the base and the lid are formed of a sealable pocket having a compressible insulation lining for receiving block insulation. The flexible casing extends tightly around the container in a fully-closed position, exerting a uniform pressure on the container to improve the thermal seals.

22 Claims, 4 Drawing Sheets

COLLAPSIBLE VACUUM PANEL CONTAINER

CROSS-REFERENCE TO RELATED APPLICATION(S)

The present application claims priority from Provisional Application Serial No. 60/143,696, filed Jul. 14, 1999, entitled SOFT-SHELL CONTAINER.

BACKGROUND OF THE INVENTION

The present invention relates to thermally insulated containers, and, more particularly, to insulated containers which are collapsible for smaller storage or shipping for reuse. A collapsible insulated container breaks down to allow it to be stored or boxed and shipped, by having some or all of the edges of the container be separable. If only some edges are separable, the remaining edges are flexible, allowing for folding of the side walls.

Collapsible insulated containers have a number of advantages over fixed wall thermally insulated containers. The walls of the collapsible containers can be folded such as when not in use or broken down to fit into a small area or shipping box. Collapsible containers are generally light weight. Though the use of collapsible containers may involve vigorous wear and tear, collapsible containers can be made durable and attractive for multiple uses over an extended period of time. In industries where product must be kept cold and shipped overnight or over a short period of time, such collapsible containers are often preferable to containers with fixed walls, because they can be collapsed during return shipment and non-use.

While collapsible containers have many advantages, the very nature of the container leads to a number of problems as compared to fixed wall containers. The collapsible container must have either flexible side walls or separable side walls to allow for folding of the container. Separable sidewalls can lead to thermal problems including the escape of heat or cold from the container through gaps between the sidewalls, the base and/or the cover. In addition, the relative fit of the separable edges of the container is determined for each use upon set-up, precise dimensions may vary and thermal problems may vary from use to use.

The design of the collapsible container needs to be efficient and inexpensive, from the stand point of both the cost of the materials and the amount of the materials used. The collapsible container should also be easy to manufacture. In addition, depending on the type of thermal insulation used, the insulation of the collapsible container may be damaged or punctured during use. And finally, the container must be easy to assemble such that potential thermal problems are minimized during the set-up process.

BRIEF SUMMARY OF THE INVENTION

A soft-sided, collapsible insulative container having a base, peripheral sidewalls extending from the base, and a lid. The sidewalls fold upward from the base at a fold hinge and releasably attach at their vertical edges to form an enclosure. The lid fits the top of the enclosure. Each of the sidewalls, the base and the lid are formed of a pocket for receiving block insulation. The pocket is lined with compressible insulation. Each pocket may be sealed to secure the block insulation.

Figure 1:
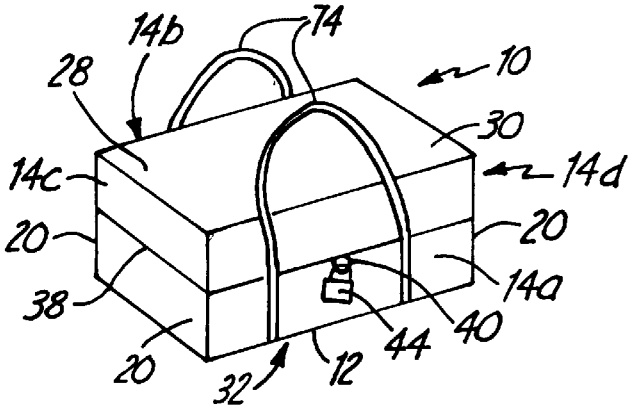
FIG. 1 is a perspective view of a collapsible vacuum panel container in the set-up and assembled position according to the present invention.

While the above-identified illustrations set forth preferred embodiments, other embodiments of the present invention are also contemplated, some of which are noted in the discussion. In all cases, this disclosure presents the illustrated embodiments of the present invention by way of representation and not limitation. Numerous other minor modifications and embodiments can be devised by those skilled in the art which fall within the scope and spirit of the principles of this invention.

DETAILED DESCRIPTION

A container 10 of the present invention generally includes a base 12, sidewalls 14, and a lid 16. Each of the sidewalls 14 are flexibly attached to the base 12 by a flexible hinge 18 (shown in FIG. 5). The sidewalls 14 fold upward at the flexible hinge 18 and attach at their vertical edges 20 to form an enclosure 22 with a top opening 24 (shown in FIG. 3). The flexible hinge 18 is permanently attached to the base 12, preventing the sidewalls 14 from becoming completely separated from the base 12.

As shown in FIG. 1, the container 10 can be commonly positioned so the base 12 is at the bottom 26 of the container 10, and the sidewalls 14 extend generally upward. However, the container 10 can be used in other orientations as well, and the use of the terms "base" and "sidewall" is not intended to limit the orientation of use.

In the preferred embodiment, each of the base 12 and the sidewalls 14 are appropriately sized rectangles. In the assembled position, the sidewalls 14 are at right angles to the base 12 and to each other, so the container 10 has the shape of a box with a top opening 24.

The lid 16 is similarly rectangular and sized to fit the top opening 24 such that in the closed position the lid 16 covers the top opening 24. The lid 16 is also flexibly attached to the base 12 by a "flexible casing" or "binding casing" 28. The flexible casing 28 is integrally formed with the outside surface 30 of the lid 16 and the bottom surface 32 of the base 12. The flexible casing 28 extends beyond the edges 34 of the lid 16 and the base 12, extending down from the lid 16 and up from the base 12 to releasably attach at the midpoint 36 between the lid 16 and the base 12 along the sidewalls 14. The flexible casing 28 is formed and sized to fit tightly around the set-up container 10. In the set-up position, the flexible casing 28 will place a uniform pressure on the lid 16, base 12 and sidewalls 14. In the preferred embodiment, the flexible casing 28 covers the-entire surface area of the container 10, and the attachment is made by a zipper 38 having two zipper handles 40, allowing the container 10 to be locked with a padlock 44 or other means when in a set-up and zipped position.

Other means could be used to releasably attach the flexible casing 28 at the midpoint 36 of the container 10, including straps, snaps, hooks, or any other releasable means. In the preferred embodiment, a zipper 38 is used. Additional the zipper or other releasable connector need not be located at the midpoint 36, but rather may releasably connect the flexible casing 28 to the rest of the container 10 at the base 12, the lid 16, or at any height along the sidewalls 14. The zipper 38 pulls the two ends 46 of the flexible casing 28 together as it is zipped closed, placing and maintaining a uniform pressure on the base 12, sidewalls 14 and lid 16 of the container 10. The pressure provided by the flexible casing 28 provides several thermal benefits that will be discussed in detail in the following paragraphs.

The flexible casing 28 is formed of a durable, flexible, lightweight fabric. The flexible casing 28 must be durable to a withstand impacts, to protect against punctures or tearing, and to allow for multiple uses and reuses of the container 10. In addition, the flexible casing 28 must be able to withstand exposure to water, temperature changes, pressure changes, and numerous other damaging elements. The flexible casing 28 could be made from any lightweight, flexible and durable material, including a heavy nylon such as 400 weight or greater. In the preferred embodiment, the flexible casing 28 and the exposed exterior and interior faces of the sidewalls 14 are formed of the same material, CORDURA, such as that manufactured by DuPont.

Handles 74 may be attached to the outside of the container 10 to facilitate handling and transport. In the preferred embodiment, handles 74 are formed by two fabric straps, which extend in opposite directions from the bottom 26 of the base 12 around flexible casing 28. The handles 74 can be formed of any durable material. In the preferred embodiment, the handles 74 are formed of a heavy weight nylon approximately 1.5 inches wide. The handles 74 can be wrapped around of the sides of the container 10 and can meet over the top of the flexible casing 28 to help support the thermal container 10 during transport. In addition, velcro or other attaching means may be used to create a handle that holds the ends of the two loops together when in an closed position.

Figure 2:
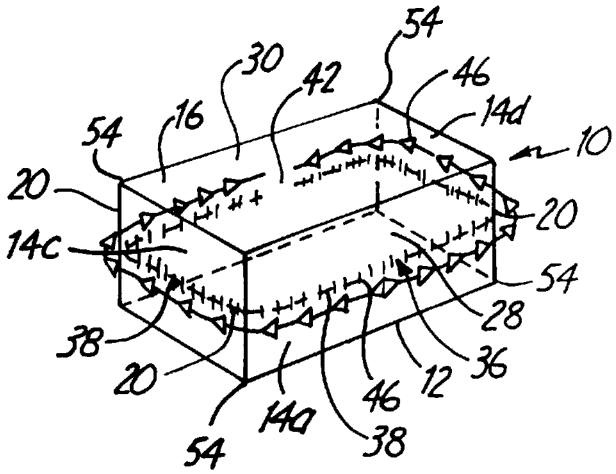
FIG. 2 is a perspective view of the container of FIG. 1 showing unzipping.

FIG. 2 illustrates an embodiment of the container 10 having a zipper 38 for attaching the flexible casing 28 at the midpoint 36. FIG. 2 illustrates the direction for unzipping the flexible casing 28, allowing the container 10 to be opened. With two zipper handles 40, the container 10 unzips in opposite directions. The flexible casing 28 connects the lid 16 to the base 12 on one side of the container 10. Unzipping the zipper 38 releases the pressure placed on the lid 16, the base 12 and the sidewalls 14 by the flexible casing 28 and allows the flexible casing 28 to be unwrapped from around the sidewalls 14.

Figure 6:
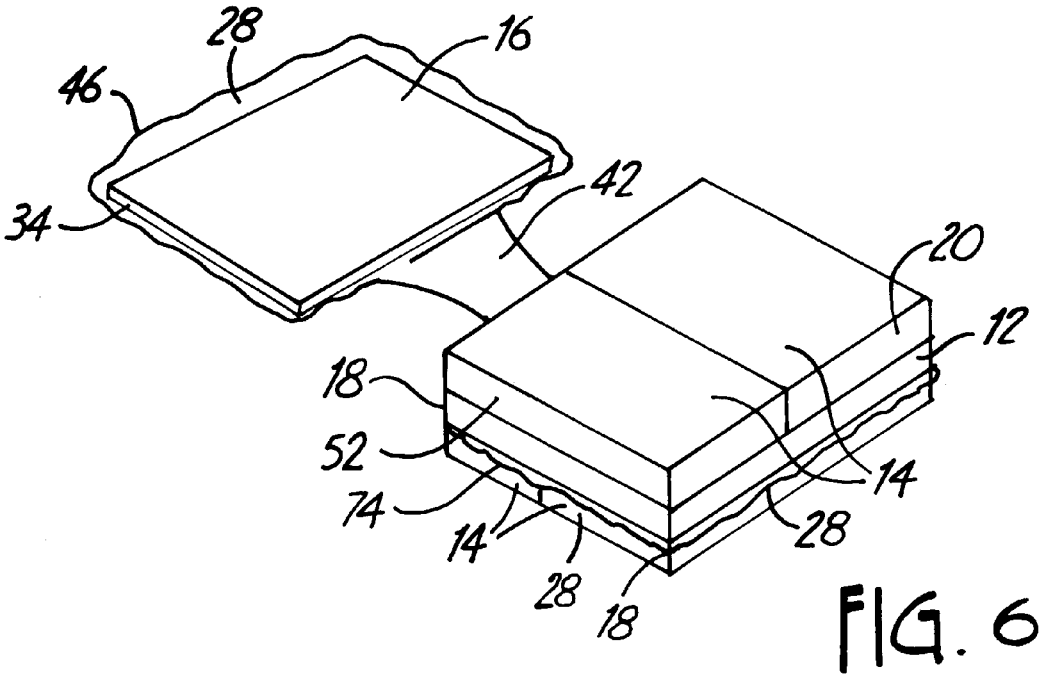
FIG. 6 is a perspective view of the container of FIG. 1 in a broken down and partially folded position.

In the preferred embodiment, the flexible casing 28 defines a narrow connection portion 42 best shown in FIGS. 2 and 6 that connects the base 12 to the lid 16. The flexible narrow connection portion 42 prevents the lid 16 from becoming separated from the container 10 in storage or during shipping. The narrow connection portion 42 prevents the two zipper handles 40 from meeting, and prevents the normal force of the sidewalls 14 and lid 16 from causing the zipper 38 to unzip. The flexible narrow connection portion 42 need not extend for the full width of a sidewall 14. In the preferred embodiment, the flexible narrow connection portion 42 extends less than the full width of the sidewall 14 to facilitate a tighter fit when the container 10 is fully closed. The lid 16 is otherwise separate from the sidewalls 14. Workers skilled in the art will appreciate that many alternative shapes can be selected for any of the base 12, the sidewalls 14, and the lid 16 to provide a closeable container 10. As shown in FIG. 2, a lock 44 may be used when the container 10 is fully closed to prevent undesired unzipping or tampering.

Figure 3:
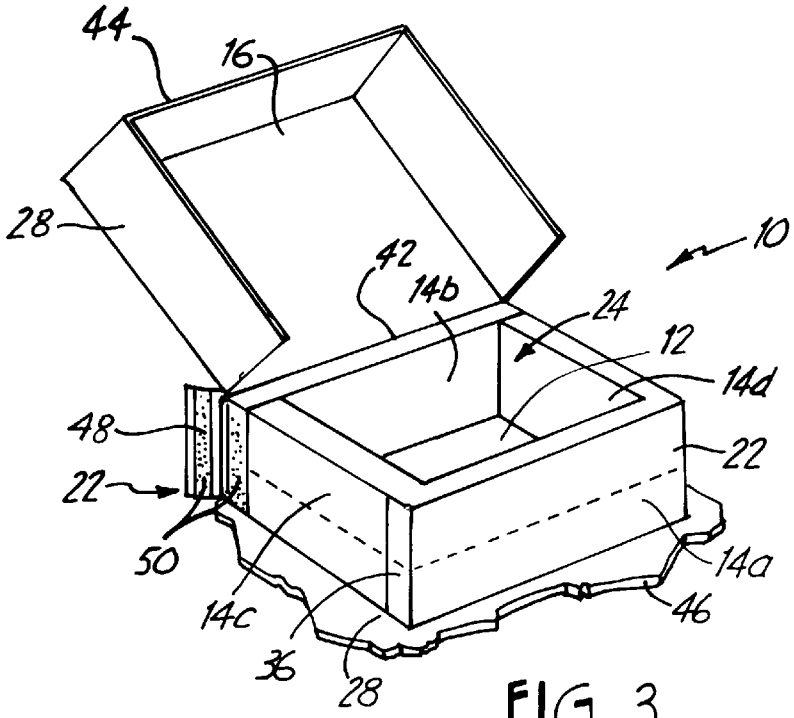
FIG. 3 is a perspective view of the container of FIG. 1 in an open position.
Figure 4:
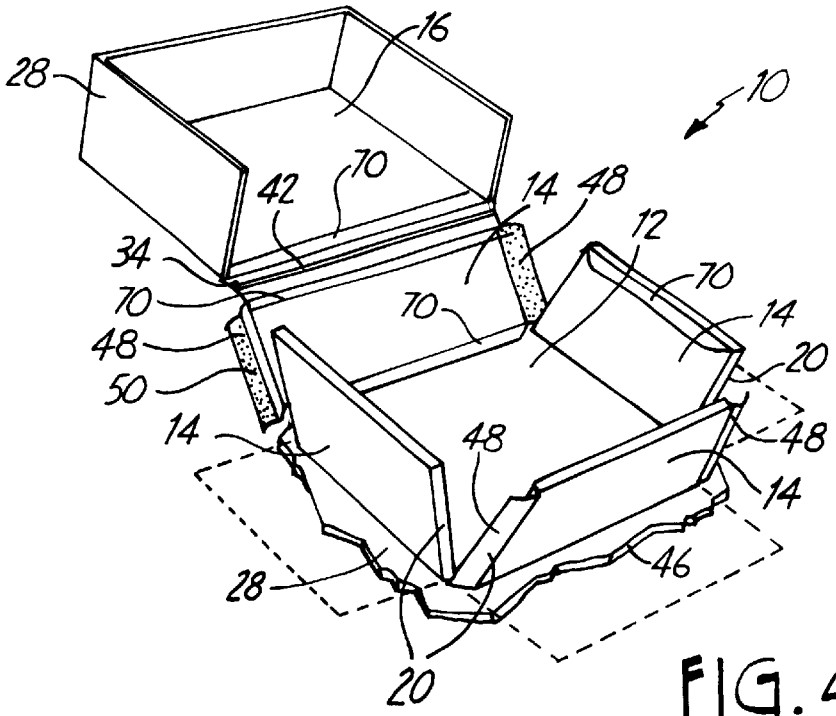
FIG. 4 is a perspective view of the container of FIG. 1 in a partially broken down position.

FIG. 3 illustrates the container 10 after the flexible casing 28 has been unzipped and unwrapped from the sidewalls 14. The lid 16 folds back on the narrow connection portion 42, exposing the sidewalls 14 with an opening 24. As shown in FIGS. 3 and 4, two opposing sidewalls 14*a,* 14*b* have flexible attachment flaps 48, which extend from the two opposing sidewalls 14*a,* 14*b*. The attachment flaps 48 extend beyond the width of sidewalls 14 *a,* 14*b* along their vertical edges 20. The flaps 48 may be made out of any flexible material, including rubber, fabric, or even thin metal. In the preferred embodiment, the flaps 48 are made out of the same material as the sidewalls 14 and the flexible casing 28.

Figure 7:
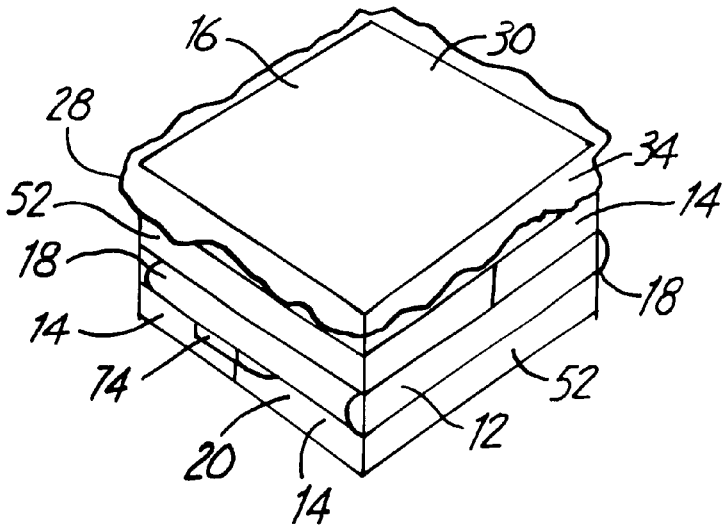
FIG. 7 is a perspective view of the container of FIG. 1 in a broken down and completely folded position.

When the container 10 is in the set-up position of FIGS. 1–3, the flaps 48 extend around the vertical edges 20 to releasably attach to the adjacent sidewalls 14*c,* 14*d*. The flaps 48 hold the sidewalls 14 together in the set-up position, helping the container 10 to maintain its shape during set-up. The flaps 48 may be attached to the outside 30 of the opposing sidewalls 14*a,* 14*b* by any means, including glue or stitching. The flaps 48 may be releasably attached to the adjacent sidewalls 14 by any means, including a hook and eye, velcro or a snap. In the preferred embodiment, the flaps 48 are fixedly attached to the outside of two opposing sidewalls 14*a,* 14*b,* and velcro is used to releasably attach the flaps 48 to the outside of the adjacent sidewalls 14*c,* 14*d*. As shown in FIGS. 3 and 4, the flaps 48 can be detached to collapse the container 10. The collapsed container 10 can then be folded into a smaller volume for return shipping as shown in FIGS. 5, 6 and 7.

In addition to helping the container 10 maintain its shape during set-up, the attachment flaps 48 also push the sidewalls 14 tightly together. This pressure increases the strength of the filly closed container 10, and improves thermal properties which will be discussed in greater detail in the following paragraphs.

In the preferred embodiment, the attachment flaps 48 are formed of the same material as the sidewalls 14, lid 16 and base 12. The attachment flaps 48 extend less than the full height of the sidewalls 14 to facilitate folding of the sidewalls 14 when the container 10 is broken down. The velcro attachment 50 is easy to assemble, and it allows the sidewalls 14 to be attached tightly during the set up process. As the velcro attachments 50 are released, the attachment flaps 48 fold back and the sidewalls 14 are no longer held in an upright position, as shown in FIG. 4.

Figure 5:
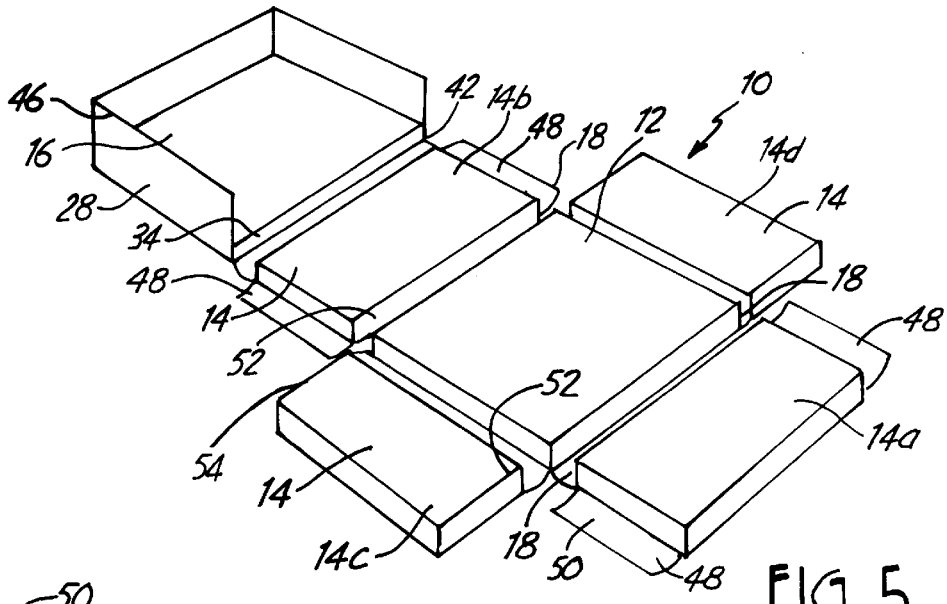
FIG. 5 is a perspective view of the container of FIG. 1 in a broken down position.

FIG. 5 illustrates the container 10 in a fully flattened or collapsed position. As can be seen in FIG. 5, each of the sidewalls 14 are permanently attached to the base 12 solely by a flexible hinge 18. The flexible hinge 18 may be formed of any lightweight, flexible material. In the preferred embodiment, the flexible hinges 18 are formed of the same material as the sidewalls 14 and the base 12, namely a heavy nylon or CORDURA. By manufacturing the flexible hinges 18 from the same material as the sidewalls 14 and the base 12, manufacturing costs are reduced, and thermal loss caused by variations in thermal expansion and contraction is reduced.

While the flexible hinges 18 may be attached to the base 12 by any means, in the preferred embodiment, the flexible hinges 18 are attached by stitching. In addition to preventing separation from the base 12, the flexible hinges 18 also provide a snug fit during set-up. In the preferred embodiment, the flexible hinges 18 is cut to be approximately 1 and ½ times the depth of the base 12, and is attached to the bottom 32 of the base 12. When the sidewalls 14 are raised and pulled upward, the flexible hinges 18 can extend to leave about ⅜ inches of space or more between the base 12 and the bottom edge 52 of the sidewall 14. The flexible hinges 18 should be slightly larger than the depth of the base 12 to allow the sidewalls 14 to fold up when the container 10 is broken down or collapsed.

In the preferred embodiment, the flexible hinges 18 extend less than the full width of the sidewalls 14 to facilitate folding. While the flexible hinges 18 could extend for the full width of the sidewalls 14 and the container 10 would still collapse and fold, slightly smaller flexible hinges 18 allows the container 10 to be folded into a smaller area.

The flexible hinges 18 and the attachment flaps 48 do not cover the edges completely. In addition, the flexible hinges 18 leave a space between the base 12 and the sidewalls 14 when the container 10 is set-up. This means there is a thermally disconnected junction defined at each corner 54 and at the edges 24,34,52. The disconnected junctions 24,34,52,54 can be a major source of thermal loss. In collapsible container, thermal loss at the disconnected junctions 24,34,52,54 may be exacerbated by imprecise attachment of the sidewalls 14 to each other and the base, or the lid 16 relative to the top opening 24 during the set-up process.

FIG. 5 illustrates the container 10 in the fully collapsed position. The collapsed container 10 may be folded further, as shown in FIGS. 6 and 7. The resulting collapsed and folded container 10 (shown in FIG. 7) will occupy less space than the assembled container 10 (FIGS. 1 and 2). For example, a collapsible container 10 that is 18 inches long, 18 inches wide, and 12 inches high can be collapsed and folded into a volume that is 18 inches long by 18 inches wide by 6 inches high. The size of the base 12 and lid 16 determine the length and width of the collapsed and folded container 10. The thickness of the sidewalls 14, base 12, and lid 16 together determine the height of the collapsed and folded container 10. In the preferred embodiment, the collapsed container 10 can be folded to fit inside a return volume which is 50% or less of the set-up volume, so that it can be returned for reuse. The flexible hinges 18 allow the sidewalls 14 to fold flat as shown to create a small object for shipping.

Figure 8:
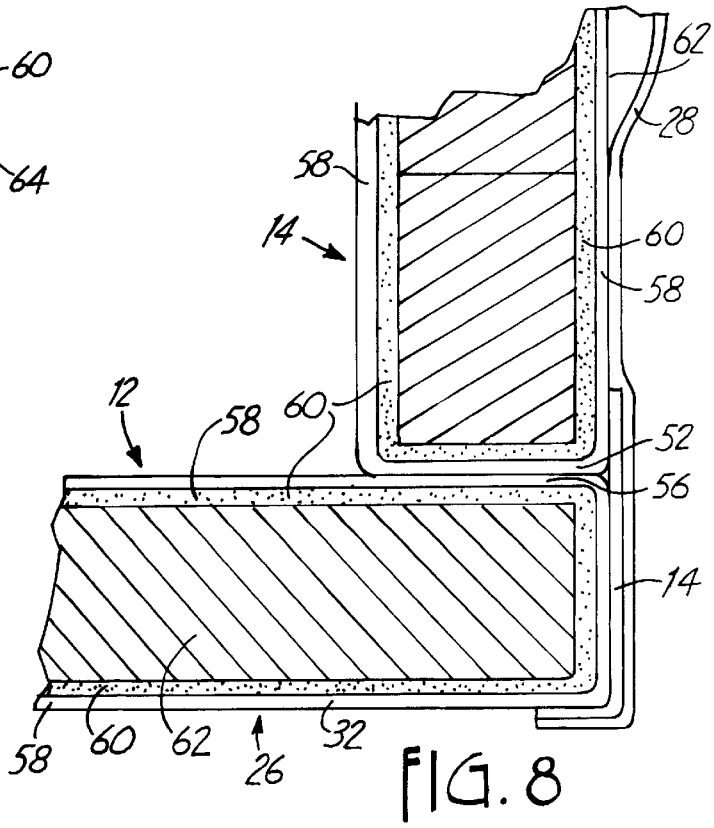
FIG. 8 is a cross-sectional view of a vertical cut through a side and base of the container of FIG. 1.

FIG. 8 illustrates the junction between a sidewall 14 and the base 12 in the closed position. When the container 10 is in a closed position, the sidewalls 14 fold upward onto the base 12 to form the enclosure with a top opening 24. The bottom edge 52 of the sidewalls 14 rest on the upper surface 56 of the base 12, but the flexible hinges 18 do not pull the sidewalls 14 and the base 12 together. When the lid 16 is placed on top of the top opening 24, the weight of the lid 16 and the sidewalls 14 places slight pressure on the compressible insulation layer.

Each sidewall 14, the base 12 and the lid 16 are generally formed of several layers, including an inside wall 58, a continuous lining of compressible insulation 60, block insulation 62, and an outer wall 64. The benefits of the continuous lining of compressible insulation 60 together with block insulation 62 between inside wall 58 and outer wall 64 are further described in application number 09/347,663 filed Jul. 6, 1999, which is hereby incorporated by reference. As used herein, the term "block insulation" is intended to include any insulation product which is substantially rigid, uncompressible and shape retaining in conditions of use. The inside wall 58 and the outer wall 64 are attached on three edges to form a pocket 66 with an opening 68. The pocket 66 is sized to fit block insulation 62.

Figure 9:
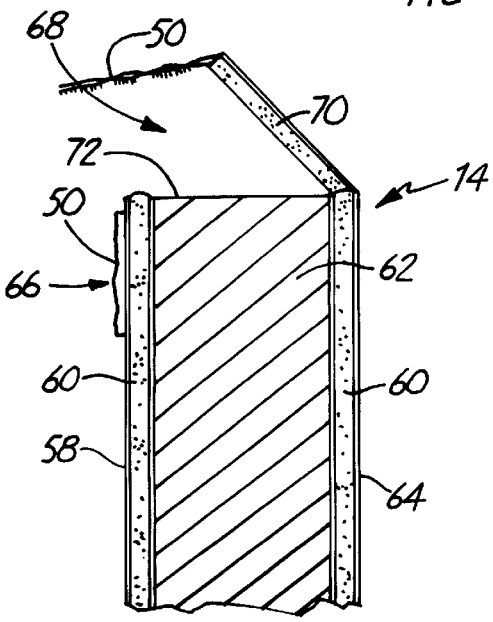
FIG. 9 is an cross-sectional view of a wall of the container of FIG. 1.

The outer wall 64 may extend beyond the edge 72 of the block insulation 64, forming a wall flap 70 which may be folded over the opening 68 to enclose the block insulation 62 as shown in FIG. 9. The outer wall 64 is releasably attached to the inner wall 58 to form a closed pocket 66. In the preferred embodiment, velcro 50 is used to form the attachment. The releasable attachment 50 allows for replacement of the block insulation 62 if the block insulation 62 becomes damaged or cracked during use.

While in another embodiment, the wall flap 70 could extend from the inside wall 58 and attach to the outer wall 64, the resulting structure would be less asthetically pleasing. Further, by maintaining the attachment of the flap 70 on the inside of the container, the flap junction poses less of a threat from the ambient environment. The junction is maintained inside, so that even if it is not fastened completely, it will not allow outside air into the sidewall.

Further, the lid 16 and the base 12 have similar pockets. Both have a wall flap 70 which closes on the inside of the enclosure 22. Base 12 has a wall flap 70 (not shown), which the flap 70 closes on the inside of the enclosure 22, behind a hinge 18.

The compressible insulation 60 serves as a continuous lining for the inside of the pocket 66. Each sidewall, the rear wall, the front wall, the base 12 and the lid 16 have such a pocket 66. Generally, the outer wall 64 extends further than the inner wall 58 to form a flap 70 that folds over the pocket opening 66 and releasably attaches to the inner wall 58. In an another embodiment, the inside wall 58 and the outside wall 64 may both extend beyond the edge 72 of the block insulation 62, overlapping to releasably close the pocket 66. Alternately, the flap 70 could be permanently sealed. In the preferred embodiment, the attachment is releasable to permit changing of the block insulation 64. The flap 70 is also lined with compressible insulation 60.

Each piece of block insulation 64 slides into its respective pocket 66. When each pocket 66 is sealed closed around its block insulation 62, the block insulation 62 is surrounded on all six sides by compressible insulation 60. The compressible insulation 60 reduces convection currents along the edges 72 and through the block insulation 62. When the container 10 is fully assembled, the compressible insulation 60 is compressed between the block insulation 62 and the inside and outer walls 58,64, improving the thermal characteristics of the junctions 24,34,52,54. In addition, the compressible foam 60 serves has a layer of protection for the rigid block 62 or panel insulation inside the pocket 66, protecting the block insulation 62 from impacts.

While any block insulation 62 can be used in the pockets 66 of the thermal container 10, in the preferred embodiment, vacuum panels are employed. Vacuum panels have a higher R factor than typical block insulation 62. Vacuum panels are generally formed by evacuating the air from a block of open cell insulation. The vacuum is maintained by wrapping the evacuated insulation in an air tight cover. However, such insulation loses much of its thermal benefit if the vacuum is lost. The insulation wrapping can be punctured, and during shipping and storage, the panels may be damaged and the vacuum lost.

The compressible insulation 60, in addition to limiting convection through and around the block insulation 62, also provides a layer of protection against puncture or tearing. By surrounding the block insulation 62, the compressible insulation 60 buffers the block insulation 62 from external shocks and impacts. In the preferred embodiment, the compressible insulation 60 is a FLER-4 Ether foam having an average density of 1.65 lbs.

In the preferred embodiment, the inside wall 58 and the outside wall 64 of the container 10 are formed of 430 nylon or CORDURA, as manufactured by DuPont. However, any material that is durable under disparate environmental conditions and that can maintain its appearance over time would suffice, including flexible fabrics and rigid shell walls disclosed in application number 09/347,663. Specifically, such material should be resistant to surface abrasions, puncture, water exposure, and other shipping or storage hazards.

In the preferred embodiment, the compressible insulation 60 is attached to the inside of the pocket 66 and the wall flap 70. The preferred compressible insulation 60 is an open cell foam insulation, preferably an FLER-4 Ether, that can be laminated to the fabric by a heat lamination process; however, other compressible insulation 60 and attachment means could be employed. Lamination reduces the number of air pockets between the open cell compressible foam 60 and the outside durable material 58,62, reducing natural convection between the compressible foam 60 and the outside material 58,64. While the lamination process is preferred, other means for attaching the compressible foam to the outer and inner walls may work, such as adhesives or stitching. If desired, the compressible foam 60 may be unattached to the outside material 58, 64. Compressible foam 60 may be secured in the pocket 66 merely by wrapping the compressible foam 60 around the block insulation 62 prior to insertion of the block insulation 62 into the pocket 66, as taught in application number 09/347,663.

The materials used in the preferred embodiment do not have much weight. In fact, in the fully set-up position, only the attachments provide significant pressure on the sidewalls 14, base 12 and lid 16. This is where the flexible casing 28 overcomes the problems presented by the thermal junctions 24,34,52,54 and significantly improves the thermal properties of this container 10 over other prior art collapsible containers.

When closed around the container 10, the flexible casing 28 induces a uniform "hoop stress", compressing the block insulation 62 into the compressible foam insulation lining 60 in all three of length, width and height directions. The flexible casing 28 presses the sidewalls 14 into the base 12 and pushes the lid 16 down onto the sidewalls 14, improving the seals at the thermal junctions 24,34,52,54. The compressible foam insulation is then compressed both by the block insulation 62 and by the adjacent sidewall 14*a,* 14*b,* 14*c,* 14*d* and base 12, thereby improving the thermal properties of the container 10 at the junctions 24,34,52,54. With the thermal benefits of the present invention, the container can have an R-value of 20 or greater. The preferred embodiment of the present invention, utilizing one inch thick vacuum panels, has been tested to have an R-value of 22 in its fully set-up position. During a test involving frozen foods placed inside the collapsible container 10 of the present invention (i.e., cubing out the container 10 with blocks of ice cream), with the flexible casing 28 closed and zipped, and with an ambient outside temperature of 85 degrees Fahrenheit, the steady state temperature difference between the bottom center of the container 10 and an inside corner of the container 10 measured less than one degree. In addition, with the use of about eight pounds of phase change material described in U.S. Pat. No. 5,976,400, incorporated herein by reference, the ice cream filled container 10 was able to maintain below 0° F. temperatures under the same conditions for more than 24 hours. Though the container 10 is collapsible, the hoop stress placed by the flexible casing 28 significantly reduces thermal loss through the sidewalls 14 and particularly at the thermal junctions 24,34,52,54.

In addition, the flexible casing 28 secures right angle orientation between the base 12, the sidewalls 14 and the lid 16, rending the container 10 more rigid and strong. When the flexible casing 28 is zipped closed, the container 10 can withstand over a 100 pounds of pressure acting vertically on the sidewalls 14. Thus, the container 10 can be shipped through normal channels and endure stacking without collapsing the container 10, protecting the contents during use. The limiting factor for the stackability or strength of the collapsible container 10 is the compression strength of the vacuum panel or block insulation 62.

The fabric design and structure of the thermal container 10 has the additional advantage of being infinitely scalable. There is no tooling required for manufacturing the container 10, and no substantial limiting factors as to the size and the availability of the vacuum panel insulation.

Figure 10:
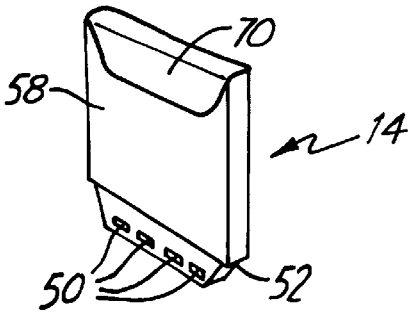
FIG. 10 is a perspective view of an alternative embodiment of the wall of the container of FIG. 1 that is fully separable from the container.

Although the present invention has been described with reference to preferred embodiments, workers skilled in the art will recognize that changes may be made in form and detail without departing from the spirit and scope of the invention. For example, FIG. 10 shows an alternative embodiment of the side wall 14 of the container of FIG. 1, which does not include hinges but rather is fully separable from the rest of the container. The side wall 14 of FIG. 10 still includes a pocket with a closeable pocket opening, and the block insulation can still be a vacuum panel. Velcro 50 can be used to releasably attach the bottom edge 52 of the side wall to the base 12. Because the flexible casing 28 provides the compressive hoop stress pushing the side wall 14 to the base 12, thermal losses at the junctions between the side wall 14 and the base 12 can be minimized even with completely detachable side walls.

What is claimed is:

1. A collapsible insulative container comprising:

a base;

side walls extending from the base; and a lid;

wherein the side walls fold upward from the base at a fold hinge, the side walls releasably attaching to each other at vertical edges to form an enclosure having a top opening;

wherein the lid is sized to fit the top opening; and wherein the side walls, the base and the lid each comprise a pocket with a pocket opening, the pocket opening for removably receiving block insulation.

2. The collapsible insulative container of claim 1, wherein the container further comprises;

a flexible casing, the flexible casing having a base portion and a lid portion, the base portion integrally formed with the exterior wall of the base, the lid portion integrally formed with the exterior wall of the lid, the flexible casing defining a flexible hinge connecting the base to the lid, the flexible hinge extending the fill height of a sidewall, the flexible casing having unhinged peripheral edges on both the base portion and the lid portion, the unhinged peripheral edges of the base portion extending from the base toward the lid, the unhinged peripheral edges of the base portion sized to circumscribe a lower half of the enclosure, the unhinged peripheral edges of the lid portion extending from the lid toward the base, the unhinged peripheral edges of the lid portion sized to circumscribe an upper half of the enclosure, the unhinged peripheral edges of the lid portion and the base portion sized to meet at a midpoint and adapted to releasably attach when the container is fully closed, the flexible casing placing a uniform pressure on the container.

3. The collapsible insulative container of claim 1, wherein two opposing sidewalls comprise;

flexible side wall ears extending beyond the vertical edge, each side wall ear sized to wrap around the vertical edge and releasably attach to the adjacent side wall to form the enclosure.

4. The collapsible insulative container of claim 1, wherein each of the side walls, the base and the lid have a closeable flap for releasably closing the pocket opening.

5. The collapsible insulative container of claim 1, further comprising:

flexible handles extending from the base portion around opposing sidewalls, the handles sized to extend beyond the full height of the container and to meet above the lid.

6. The collapsible insulative container of claim 1, wherein each of the pockets comprises:

an inside wall;

an outside wall;

block insulation between the inside wall and the outside wall; and compressible insulation material extending across a full area of at least one of the inside wall and the outside wall.

7. The collapsible insulative container of claim 6, wherein the inside wall and the outside wall are made of flexible fabric.

8. The collapsible insulative container of claim 6, wherein the compressible insulation material is attached to the inside and outside walls of the pocket by a lamination process.

9. A collapsible insulative container of claim 6, further comprising a flexible casing, wherein the flexible casing, the inside walls and the outside walls are formed of the same material.

10. A thermally insulative container comprising:

a base;

side walls extending upward from the base to form an enclosure having a top opening; and a lid sized to fit the top opening;

wherein the side walls, the base and the lid each comprise:

a pocket with a closeable pocket opening; and a vacuum panel removably received within the pocket.

11. A collapsible thermally insulative container comprising:

a base;

side walls folding upward from the base at a fold hinge, the side walls releasably attaching to each other at vertical edges to form an enclosure having a top opening;

wherein the side walls, the base and the lid each comprise:

a pocket; and a vacuum panel received within the pocket.

12. The collapsible insulative container of claim 11, wherein the container has an R-value of at least 20 in a set-up position.

13. The collapsible insulative container of claim 11, wherein each of the side walls, the base and the lid comprise a pocket removably receiving the vacuum panel, each pocket having a closeable flap allowing access to the vacuum panel.

14. A collapsible insulative container comprising:

a base;

side walls extending from the base, the side walls releasably attaching to each other at edges to form a collapsible enclosure having a top opening;

a lid sized to fit the top opening;

the base, side walls and lid in an assembly position meeting at thermal junctions; and a flexible casing secured to at least one of the lid and the base and releasably attachable relative to the other of the lid and the base, the flexible casing sized to fit around the sidewalls in an assembled position, the flexible casing releasably attaching to exert pressure on the thermal junctions.

15. The collapsible insulative container of claim 14, wherein each of the side walls, the base and the lid comprise:

block insulation; and compressible insulation.

16. The collapsible insulative container of claim 14, wherein the flexible casing covers an entire exterior surface area of the side walls in a set-up position.

17. The collapsible insulative container of claim 14, wherein the casing comprises:

a lower portion attached to the base; and an upper portion attached to the lid, the lower portion and the upper portion releasably attaching along a height of the side walls.

18. The collapsible insulative container of claim 17, wherein the lower portion and the upper portion mate at a midpoint along the sidewalls.

19. The collapsible insulative container of claim 14, wherein the flexible casing releasably attaches by a zipper.

20. The collapsible insulative container of claim 14, wherein the flexible casing comprises a narrow connection portion connecting the base to the lid.

21. A collapsible insulative container comprising:

a base having an upper surface and a lower surface with a depth therebetween which contains block insulation;

side walls each connected to the base by a flexible hinge, the side walls releasably attaching to each other at adjacent edges to form an enclosure having a top opening, each of the side walls comprising block insulation; and a lid sized to fit the top opening;

wherein the flexible hinge for at least one side wall allows the side wall to fold flat against the upper surface of the base, and wherein the flexible hinge for at least one adjacent side wall allows that adjacent side wall to fold flat against the lower surface of the base.

22. The collapsible insulative container of claim 21, wherein the flexible hinges attach to the lower surface of the base and extend upward to allow the block insulation for the side walls to be positioned with an edge contacting the upper surface of the base.

* * * * *

UNITED STATES PATENT AND TRADEMARK OFFICE

CERTIFICATE OF CORRECTION

PATENT NO. : 6,220,473 B1
DATED : April 24, 2001
INVENTOR(S) : Joseph Lehman et al.

It is certified that error appears in the above-identified patent and that said Letters Patent is hereby corrected as shown below:

Column 8,
Line 63, delete "fill", insert -- full --

Signed and Sealed this

Ninth Day of April, 2002

*Attest:*

*Attesting Officer*

JAMES E. ROGAN
*Director of the United States Patent and Trademark Office*